US008118067B2

(12) United States Patent
Al-Awadh

(10) Patent No.: US 8,118,067 B2
(45) Date of Patent: Feb. 21, 2012

(54) SULFUR LOADING APPARATUS

(75) Inventor: Mohammed S. Al-Awadh, Hofuf (SA)

(73) Assignee: Saudi Arabian Oil Company (SA)

( * ) Notice: Subject to any disclaimer, the term of this patent is extended or adjusted under 35 U.S.C. 154(b) by 0 days.

(21) Appl. No.: 12/977,330

(22) Filed: Dec. 23, 2010

(65) Prior Publication Data

US 2011/0088807 A1 Apr. 21, 2011

Related U.S. Application Data

(63) Continuation of application No. 11/455,532, filed on Jun. 19, 2006, now Pat. No. 7,958,913.

(51) Int. Cl.
*B65B 31/00* (2006.01)

(52) U.S. Cl. ..... 141/59; 141/7; 141/82; 141/263; 141/279

(58) Field of Classification Search ..... 137/615; 141/1, 5, 7, 37, 59, 82, 192, 195, 250, 263, 141/266, 279, 285, 387, 388
See application file for complete search history.

(56) References Cited

U.S. PATENT DOCUMENTS

| | | | | |
|---|---|---|---|---|
| 3,831,644 | A | 8/1974 | Berg et al. | |
| 3,924,666 | A | 12/1975 | Raison | |
| 4,180,272 | A | 12/1979 | Heitz | |
| 5,184,654 | A | 2/1993 | Benzing | |
| 6,065,922 | A | 5/2000 | Kato et al. | |
| 6,099,616 | A * | 8/2000 | Jenne et al. | 95/1 |
| 7,225,840 | B1 | 6/2007 | Craig et al. | |
| 2003/0102047 | A1 | 6/2003 | Lemmon | |

FOREIGN PATENT DOCUMENTS

| | | |
|---|---|---|
| DE | 20 2006 019 847 U1 | 5/2007 |
| GB | 1439291 | 6/1976 |

OTHER PUBLICATIONS

Examination Report issued by the European Patent Office dated Sep. 29, 2011; European Patent Application No. 07794398.3.

* cited by examiner

*Primary Examiner* — Gregory Huson
*Assistant Examiner* — Jason Niesz
(74) *Attorney, Agent, or Firm* — Bracewell & Giuliani LLP

(57) ABSTRACT

A chemical loading system is used for loading a molten chemical into a tanker. The chemical loading system includes a source supplying a molten chemical and a tanker for receiving the molten chemical. The chemical loading system has a stationary feed line supplying a chemical from the source. An extendable loader has a feed passage that is in fluid communication with the feed line. The extendable loader has a retracted position and an extended position relative to the feed line. The feed passage is adapted to have at least a portion thereof inside the tanker when in the extendable loader is in the extended position. A hoist assembly selectively extends and retracts the extendable loader assembly between the retracted and extended positions.

25 Claims, 4 Drawing Sheets

SULFUR LOADING APPARATUS

RELATED APPLICATIONS

This patent application is a continuation of U.S. Nonprovisional patent application Ser. No. 11/455,532 filed on Jun. 19, 2006, which is hereby incorporated by reference in its entirety.

BACKGROUND OF THE INVENTION

1. Field of the Invention

The present invention relates generally to a product conveyance assembly, and more specifically to an apparatus for transferring a chemical substance to a movable tanker.

2. Background of the Invention

Loading arm assemblies are utilized for the transfer of chemicals from a processing plant to a tanker for transportation. Loading arm assemblies that are used for the loading of molten chemicals, such as, sulfur have numerous drawbacks associated with the safety to the operator and the reliability of the equipment. In prior art assemblies, loading arms included flexible non-metallic tubing, or tubing that was maneuverable do to swivel joints, that was manually pulled and positioned over an opening of tanker. A vacuum piping system was often associated with the maneuverable loading arms for collecting some of the fumes emanating from the molten sulfur being loaded into the tanker.

Molten sulfur often caused corrosive damage to the non-metallic tubing or piping, and to the swivel joints that needed to be replaced repeated. Moreover, the operator had to push and pull the prior art loading arms while moving about the upper surface of the tanker. This exposed the operator to awkward and often dangerous situations while handling the molten sulfur loading arms. The operator had to negotiate curved tankers with protuberances and guard assemblies formed on the tanker surface around the tanker opening, and the operator was exposed to the heat associated with the molten sulfur being transferred to the tanker the operator was walking upon. Furthermore, the operator was often exposed to the fumes from the chemicals emanating from within the tanker during the loading process while engaging and disengaging the loading arm with the tanker.

SUMMARY OF THE INVENTION

A chemical loading system is used for loading a molten chemical into a tanker. The chemical loading system includes a source supplying a molten chemical and a tanker for receiving the molten chemical. The chemical loading system has a stationary feed line supplying a chemical from the source. An extendable loader has a feed passage that is in fluid communication with the feed line. The extendable loader has a retracted position and an extended position relative to the feed line. The feed passage is adapted to have at least a portion thereof inside the tanker when in the extendable loader is in the extended position. A hoist assembly selectively extends and retracts the extendable loader assembly between the retracted and extended positions.

The molten chemical is typically molten sulfur. Feed seals are typically positioned between the feed line and the feed passage. The chemical loading system can also include a heating jacket mounted to the feed line. The heating jacket carries a heating fluid to keep the molten chemical from solidifying in the feed line. The heating fluid can be steam, and a heating fluid recovery unit in fluid communication with the heating jacket collects and recovers the heating fluid when the heating fluid exits the heating jacket.

The chemical loading system of can also include a platform positioned adjacent the tanker. The platform is also positioned away from the extendable loader assembly. A controller is positioned on the platform and is in communication with the hoist assembly for selectively extending and retracting the extendable loader assembly.

The extendable loader assembly of the chemical loading system can also include a ventilation passage in fluid communication with the interior of the tanker when the extendable loader is in its extended position. The ventilation passage extends parallel to the feed passage. The ventilation passage moves in unison with the feed passage when the extendable loader assembly is moved between its extended and retracted positions. The chemical loading system can also include a ventilation line in fluid communication with the ventilation passage. The ventilation line is in fluid communication with a collection unit that collects the fumes from the molten chemical.

A loading assembly is used for loading molten sulfur into a tanker. The loading assembly includes a hood adapted to cover an opening of the tanker. A pair of telescoping conduits are attached to the hood. One of the telescoping conduits is for flowing the molten sulfur into the tanker. The other of the telescoping conduits is for ventilating fumes from the molten sulfur. Each of the pair of telescoping conduits have an upper portion and a lower portion. The lower portions being movable in unison with the hood between a raised position and a lowered position.

The loading assembly can also have seals positioned between the upper and lower portions of the telescoping conduits. A plurality of metal plates may be connected to the outer surface of a lower end of each of the upper portions of the telescoping conduits. The lower conduits can receive the upper conduits when the lower portions and the hood are moved to the raised position. The telescoping conduits can extend parallel to each other from the hood.

The loading assembly can also include a driven winch that selectively raises the hood between the raised and lowered positions. The loading assembly can also include a liquid sensor extending downward from the hood that is adapted to determine when the molten sulfur reaches a predetermined level within the tanker.

A method for loading molten sulfur into a tanker includes the step of providing an extendable loader having a feed passage. The extendable loader is movable by a remotely controlled winch between a retracted position and an extended position. The method then includes positioning a tanker beneath the extendable loader for receiving a molten sulfur. The feed passage is extended to the extended position so that least a portion thereof is inside the tanker. The molten sulfur is conveyed into the tanker from a sulfur source through a stationary feed line in fluid communication with the feed passage. The feed passage is retracted to the retracted position. The tanker is moved from beneath the extendable loader.

The method can also include the step of providing a ventilation passage in fluid communication with the interior of the tanker when the extendable loader is in its extended position. The fumes emanating from the molten sulfur within the tanker are then collected with the ventilation passage.

DETAILED DESCRIPTION OF THE PREFERRED EMBODIMENT

Figure 1:
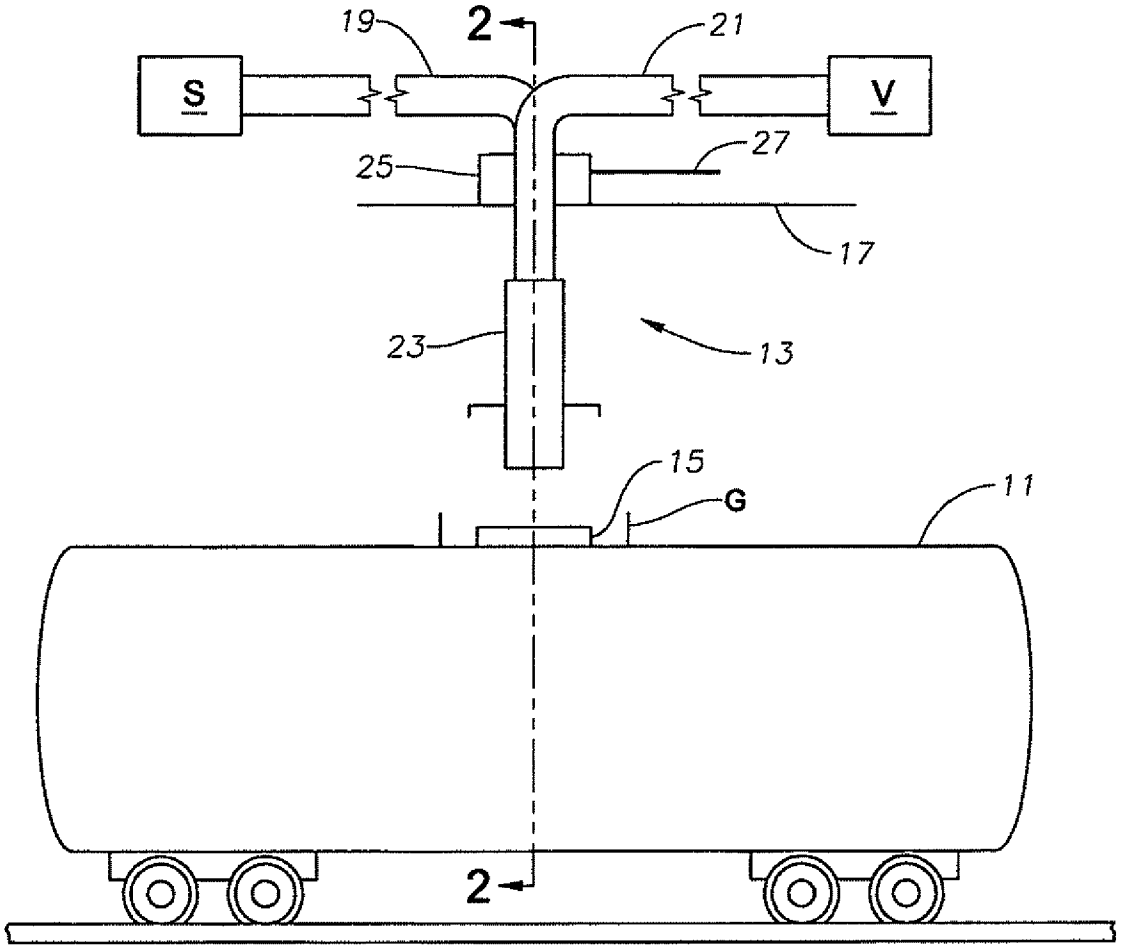
FIG. 1 is a schematic view of a movable tanker positioned beneath a sulfur loading assembly constructed in accordance with the present invention.

Referring to FIG. 1, a movable tanker 11 is illustrated below a sulfur loading assembly 13. Movable tanker 11 is preferably supported on a chassis and wheel assembly allowing movable tanker 11 to be moved into position for receiving a load from sulfur loading assembly 13. As will readily be appreciated by those skilled in the art, although tanker 11 is illustrated as a railroad tanker, movable tanker 11 can also be a tanker that is towed behind a vehicle such as an eighteen wheeler.

An opening 15 is preferably formed on an upper surface of movable tanker 11 for receiving a load from loading assembly 13. In the preferred embodiment, opening 15 is positioned beneath loading assembly 13 for receiving a payload into tanker 11. An opening guard G is formed around opening 15 on an upper surface of tanker 11.

Loading assembly 13 includes a feed line 19 for supplying a supply of product from a product source S. Loading assembly 13 also preferably includes a ventilation line 21 that is in fluid communication with a ventilation system V. Ventilation line 21 preferably receives fumes from tanker 11 during the loading process of the supply into tanker 11. Ventilation line 21 communicates fumes from tanker 11 and conveys the fumes to the ventilation system V so that the fumes are either collected for disposal or recirculated within other processing equipment.

In the preferred embodiment, source S provides a supply of molten sulfur to tanker 11. When molten sulfur is the product being supplied, ventilation line 21 preferably carries the sulfur fumes to a ventilation system V so that fumes are collected for disposal or recirculated to source S.

Figure 2:
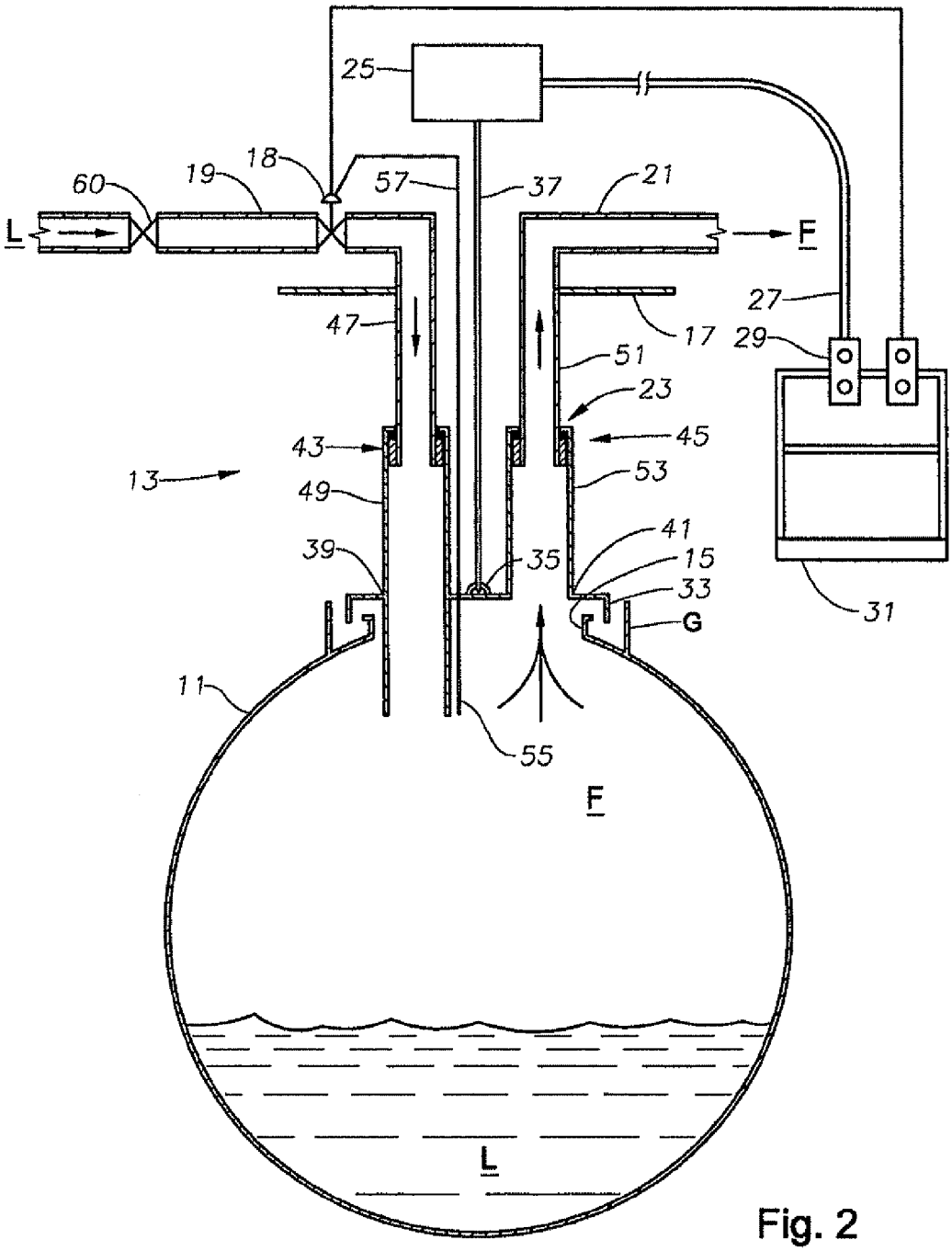
FIG. 2 is a schematic sectional view of the movable tanker and the sulfur loading assembly of FIG. 1 when viewed along line 2-2, with the sulfur loading assembly in its lowered positioned.
Figure 3:
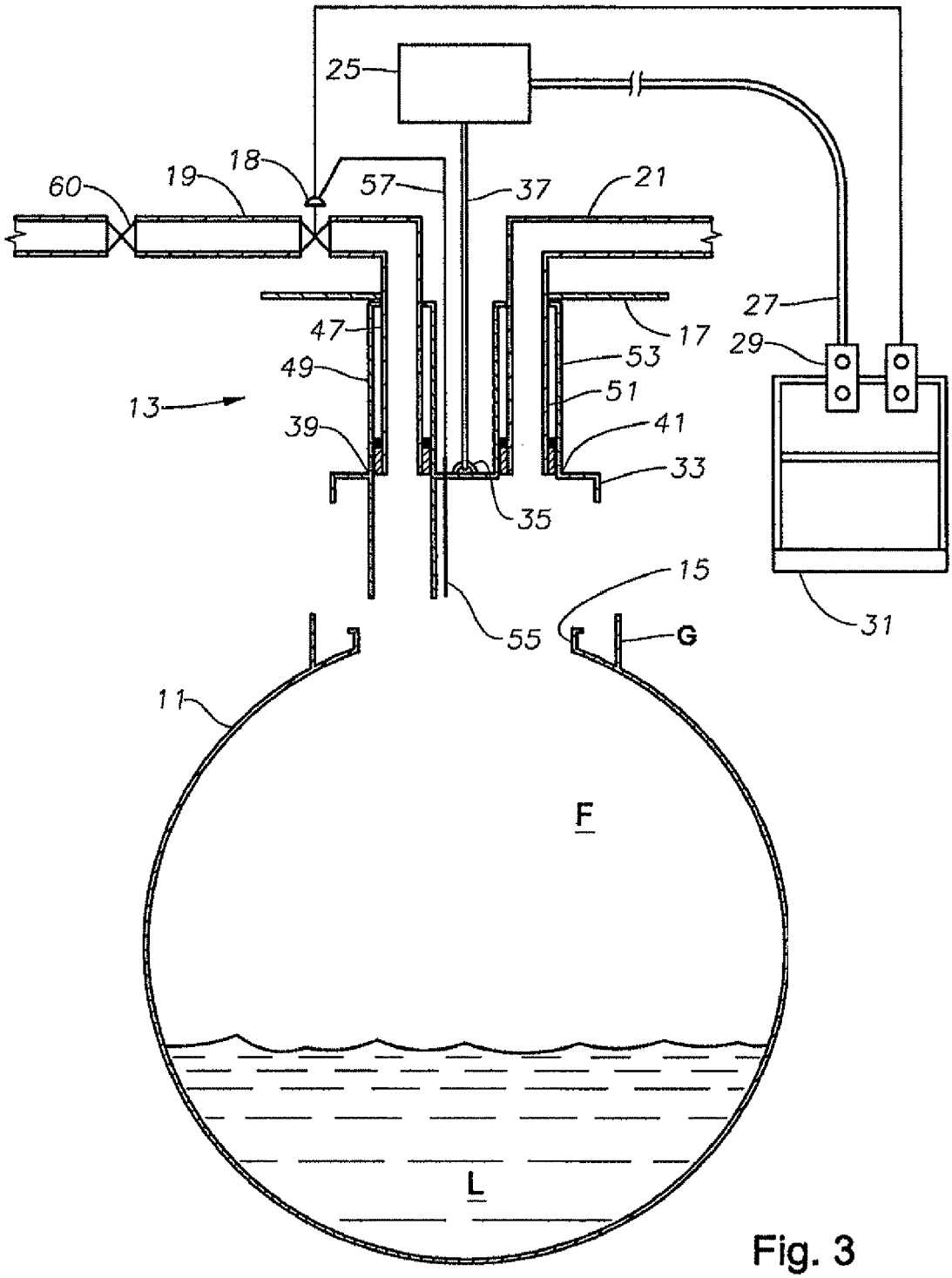
FIG. 3 is a schematic sectional view of the movable tanker and the sulfur loading assembly of FIG. 1 when viewed along line 2-2, with the sulfur loading assembly in its raised positioned.

Loading assembly 13 preferably includes an extendable loader 23 that selectively moves between raised and lowered positions (FIGS. 2 and 3). A winch 25, which can be motor driven or pneumatically driven, is connected to extendable loader 23 via a control line 27 to raise and lower extendable loader 23 between its raised and lowered positions. A support structure 17 preferably supports feed and ventilation lines 19, 21 as well as winch 25 and extendable loader 23.

Referring to FIGS. 2 and 3, a controller 29 is positioned in communication, such as pneumatic or electrical, with control line 27 adjacent a platform 31. As will be readily appreciated by those skilled in the art, an operator can operate winch 25 with controller 29 from a position spaced-apart from tanker 11 and loading assembly 13 when standing upon platform 31.

Extendable loader 23 includes a hood 33 that is raised and lowered relative to support structure 17. Hood 33 covers and encloses opening 15 of tanker 11. Hood 33 helps in the collection of fumes F being collected through ventilation line 21 during the loading process. A support mount 35 is connected to hood 33. A support line 37 connects to support mount 35 and extends upward to winch 25. Support line 37 can be a cable, a chain, or any suitable line for lifting and lowering extendable loader 23 with winch 25.

Hood assembly 33 also preferably includes an inlet opening 39 and an outlet opening 41. Inlet opening 39 is in fluid communication with source S for receiving liquid L from source S through feed line 19, and outlet opening 41 is in fluid communication with ventilation line 21 for transferring fumes F from tanker 11 during the loading process. As will be readily appreciated by those skilled in the art, during the loading process, liquid L is transferred through feed line 19, and inlet opening 39 into tanker 11 where liquid L accumulates in a lower portion of tanker 11.

Extendable loader 23 includes a supply telescoping conduit 43 that connects to hood 33 at inlet opening 39. Extendable loader 23 also preferably includes a vent telescoping conduit 45 connecting to hood 33 at outlet opening 41. As best illustrated in FIGS. 2 and 3, telescoping conduits 43 and 45 allow extendable loader 23 to be raised and lowered between the lowered or extended position shown in FIG. 2 and the raised or retracted position shown in FIG. 3.

Supply telescoping conduit 43 preferably includes a supply inner conduit 47 and a supply outer conduit 49. Supply outer conduit 49 preferably slides up and down relative to supply inner conduit 47. Supply inner conduit 47 rigidly connects to feed line 19 in a manner such that supply inner conduit 47 does not move up and down relative to support structure 17.

As will be readily appreciated by those skilled in the art, when extendable loader 23 is moved between its upper and lower positions, supply inner conduit 47 remains stationary relative to support structure 17 and winch 25, while supply outer conduit 49 moves with hood 33. Similarly, vent telescoping conduit 45 also includes vent inner conduit 51 and vent outer conduit 53. Vent inner conduit 51 connects to ventilation line 21 in a manner such that vent inner conduit 51 does not move relative to support structure 17 when extendable loader 23 is moved between its raised and lowered positions. Vent outer conduit 53 preferably slides telescopingly relative to vent inner conduit 51 when winch 25 raises and lowers hood 33.

Supply outer conduit 49 preferably extends below hood 33 so that supply outer conduit 49 extends below opening 15 when extendable loader 23 is in its lowered position relative to support structure 17. With supply outer conduit 49 positioned below opening 15, liquid L advantageously flows into tanker 11 without as much liquid spilling due to missing opening 15.

Extendable loader 23 preferably includes a sensor 55 extending below hood 33 adjacent supply outer conduit 49. Sensor 55 preferably extends below hood 33 into tanker 11 through opening 15 such that sensor 55 detects when fluid L reaches a predetermined level within tanker 11. A sensor line 57 is in communication with sensor 55 and extends upward to support structure 17. Sensor line 57 is preferably in electrical communication with control line 27 so that a predetermined signal can be communicated to a level control valve (LCV) 18 when fluid level L reaches a predetermined level within tanker 11 to alert the operator of the fluid level L within tanker 11 during the product transfer process. The predetermined signal can be communicated to LCV 18, for automatically stopping flow from source S, and to activate a siren for recognition by the operator. The operator can manually stop flow if necessary.

In operation, an empty tanker 11 is positioned underneath support structure 17 such that opening 15 is located below loading assembly 13. While standing upon platform 31 an operator uses controller 29 to lower extendable loader 23 from its raised position shown in FIG. 1 and FIG. 3 to its lowered position shown in FIG. 2. While using controller 29 to control the position of extendable loader 23 relative to support structure 17, controller 29 conveys electrical or pneumatic signals to winch 25 to engage winch 25 for lowering hood 33 into position on opening 15. Liquid L is transferred from source S through feed line 19 into supply inner conduit 47 and through supply outer conduit 49 into tanker 11. Liquid L is transferred from source S after opening a manual valve upstream of LCV 18, and operating LCV 18 via a pneumatic button control valve of LCV 18. The signal to LCV 18 is electrical. As liquid L accumulates within tanker 11, the level of liquid within tanker 11 begins to rise toward supply outer conduit 49 and sensor 55. When liquid level L reaches sensor 55, an electrical signal is communicated through sensor line 57 and control line 27 to LCV 18 and controller 29 on platform 31. Preferably, LCV 18 will automatically cease the conveyance of liquid L from source S. However, the operator who is standing on platform 31 can also cease the conveyance of liquid L from source S with a push button controller to actuate LCV 18, or through a manual valve 60 positioned upstream of LCV 18.

While liquid L is accumulating within tanker 11, fumes F are communicated through opening 15 into vent outer conduit 53. Hood 33 helps to guide films F into vent outer conduit 53. Fumes F convey through vent outer conduit 53 into vent inner conduit 51 and on to ventilation line 21 for disposal as predetermined by the operator.

Upon turning off the supply of liquid from source S when liquid level L reaches the predetermined level within tanker 11, the operator uses controller 29 to activate winch 25 in order to raise hood 33 of extendable loader 23 relative to opening 15. When extendable loader 23 is in its raised position as shown in FIG. 3, the operator can move tanker 11 away from loading assembly 13. As will be readily appreciated by those skilled in the art, the operator has been able to control the loading process of the liquid L from source S without having to manually position the feed lines and ventilation lines relative to opening 15 as had been done in the past. Loading assembly 13 advantageously provides the operator with a safe process by which to load liquid L into tanker 11 from source S without being exposed to as many fumes F and the possibility of tripping over guard G while trying to position loading assembly 23 into position relative to opening 15.

Loading assembly 13 eliminates the use of flexible hoses and swiveling joints that need replacement due to the corrosiveness and the heat of molten sulfur. Having stationary supply and vent inner conduits 47, 51 allows the operator to select metals such as stainless steel, or coatings on the interior surfaces that are more resistant to corrosion under heat. The operator can also select metals such as stainless steel, or coating on the surfaces of supply and vent outer conduits 49, 53 and hood 33 that are exposed to the molten sulfur and its fumes.

Figure 4:
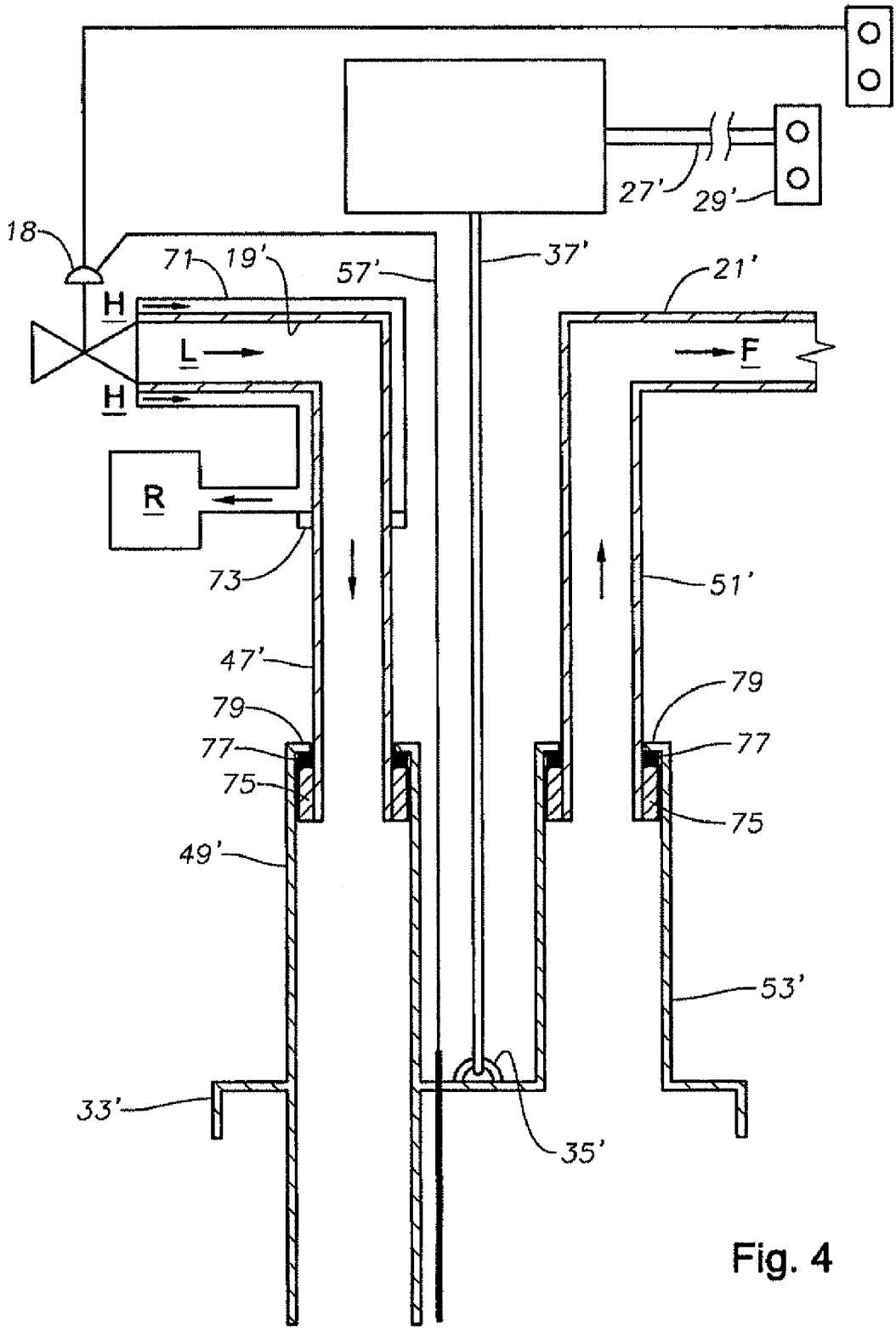
FIG. 4 is a schematic sectional view of an alternative embodiment of the sulfur loading assembly shown in FIG. 1.

Referring to FIG. 4, an alternative embodiment of loading assembly 13' is shown. In the alternative embodiment shown in FIG. 4, a heating jacket 71 surrounds a portion of feed line 19' and supply inner conduit 47'. Heating jacket 71 preferably conveys a heating liquid H while liquid L is conveyed from source S to supply inner conduit 47'. Heating liquid H carried within heating jacket 71 advantageously helps to maintain the temperature of liquid L being carried within feed line 19' so that liquid L does not decrease to a temperature such that it would change phases. A seal 73 is positioned between heating jacket 71 and supply inner conduit 47' so that heating liquid H can be guided to a recovery collector R. As will be readily appreciated by those skilled in the art, heating liquid H can be a substance such as steam for maintaining of temperature of liquid L above its temperature upon which liquid L would change phases to a solid. Heating jacket 71 can also be utilized around ventilation line 21'.

In the embodiment shown in FIG. 4, a plurality of metal plates 75 are preferably mounted to the exterior of a lower portion of supply inner conduit 47'. Metal plate 75 helped to reduce the amount of liquid L that can splash up to the inner phase of supply inner conduit 47' and supply outer conduit 49'. In the embodiment shown in FIG. 4, a seal 77 is positioned above metal plate 75. An annular cover 79 is formed on an upper portion of supply outer conduit 49'. Annular cover 79 preferably extends radially inward relative to supply outer conduit 49' toward the outer surface of inner conduit 47. Annular cover 79 preferably engages seal 77 when extendable loader 23' is in its lowered position. As will be readily appreciated by those skilled in the art, metal plates 75 also help to reduce the contact that seal 77 has with liquid L as liquid L is being conveyed into tanker 11'. In the preferred embodiment, seal 77 comprises a rubberized material. In the embodiment shown in FIG. 4, seal 77 and metal plate 75 are also positioned around vent inner conduit 51' to engage in annular cover 79 extending radially inward from vent outer conduit 53. Seal 77 also helps to reduce the amount of fumes F escaping loading assembly 13' around the physical interface of vent inner conduit and vent outer conduit 51', 53' so that fumes F are conveyed in the desired manner through vent outer conduit 53' and to vent inner conduit 51' so that fumes are properly carried to ventilation line 21' where fumes F can be disposed of in a predetermined manner.

Hoses, sensors, and sensor cables get damaged due to the movement of the prior art assemblies, as well as due to the heat and chemicals these parts interact with during operation. Such damages disable the level control and vacuum systems necessary for the safety of the operator. Loading assembly 13 helps to reduce such damage and also creates an environment where the operator is farther away from the heat and fumes from the molten sulfur.

The description and figures are merely illustrative of various embodiments. While the invention has been shown in only some of its forms, it should be apparent to those skilled in the art that it is not so limited, but is susceptible to various changes without departing from the scope of the invention.

That claimed is:

1. A chemical loading system for loading a molten chemical into a tanker, the chemical loading system comprising:

a source for supplying the molten chemical to the tanker;

a stationary feed line for supplying the molten chemical from the source;

an extendable loader assembly having a feed passage in fluid communication with the stationary feed line, the extendable loader assembly having a retracted position and an extended position relative to the stationary feed line, the feed passage being adapted to have at least a portion thereof inside the tanker when the extendable loader assembly is in the extended position, wherein the extendable loader assembly further comprises a ventilation passage that is operable to be in fluid communication with the interior of the tanker when the extendable loader assembly is in its extended position;

feed seals positioned between the stationary feed line and the feed passage;

a hoist assembly that selectively extends and retracts the extendable loader assembly between the retracted and extended positions; and a hood with an opening through which the feed passage extends, the hood adapted for enclosing an opening of the tanker when the extendable loader assembly is in its extended position, wherein the ventilation passage does not traverse the hood.

2. The chemical loading system of claim 1, further comprising:

a platform adapted to be positioned adjacent the tanker and nonadjacent to the extendable loader assembly; and a controller positioned on the platform that is in communication with the hoist assembly for selectively extending and retracting the extendable loader assembly.

3. The chemical loading system of claim 1, further comprising:

a platform adapted to be positioned remotely from the tanker and the extendable loader assembly; and a controller positioned on the platform that is in communication with the hoist assembly for selectively extending and retracting the extendable loader assembly.

4. The chemical loading system of claim 1, further comprising metal plates positioned between the stationary feed line and the feed passage, wherein the metal plates are adapted to protect the feed seals from the molten chemical.

5. The chemical loading system of claim 1, further comprising a heating jacket mounted to the stationary feed line, the heating jacket adapted for carrying a heating fluid to keep the molten chemical from solidifying in the stationary feed line.

6. The chemical loading system of claim 5, wherein the heating fluid is steam.

7. The chemical loading system of claim 5, further comprising a heating fluid recovery unit in fluid communication with the heating jacket for collecting and recovering the heating fluid when the heating fluid exits the heating jacket.

8. The chemical loading system of claim 1, further comprising a hood with an opening through which the feed passage extends, the hood adapted for enclosing an opening of the tanker when the extendable loader assembly is in its extended position.

9. The chemical loading system of claim 1, wherein the ventilation passage extends parallel to the feed passage.

10. The chemical loading system of claim 1, wherein the feed passage extends further than the ventilation passage.

11. The chemical loading system of claim 1, further comprising a hood with an opening through which the feed passage extends, the hood adapted for enclosing an opening of the tanker when the extendable loader assembly is in its extended position, wherein the ventilation passage and the feed passage exhibit concerted movement when the extendable loader assembly is moved between its extended and retracted positions.

12. The chemical loading system of claim 1, further comprising a ventilation line in fluid communication with the ventilation passage, the ventilation line adapted for being in fluid communication with a collection unit that collects fumes emanating from the molten chemical.

13. The loading assembly of claim 1, further comprising a liquid sensor that is adapted to determine when the molten sulfur reaches a predetermined level within the tanker.

14. The loading assembly of claim 13, further comprising a liquid control valve in fluid communication with the stationary feed line, wherein the liquid control valve is in communication with the liquid sensor, such that the liquid control valve is operable to stop the flow of molten sulfur to the tanker if the molten sulfur reaches the predetermined level within the tanker.

15. A method for loading molten sulfur into a tanker, the method comprising the steps of:

providing the chemical loading system of claim 1;

positioning the tanker beneath the extendable loader assembly for receiving a molten sulfur;

extending the feed passage to the extended position so that at least a portion thereof is inside the tanker; and conveying the molten sulfur into the tanker from the stationary feed line through the extendable loader assembly.

16. The method of claim 15, further comprising providing a ventilation passage in fluid communication with the interior of the tanker when the extendable loader assembly is in its extended position; and then collecting fumes emanating from the molten sulfur within the tanker with the ventilation passage.

17. The method of claim 15, further comprising retracting the feed passage to the retracted position, and then moving the tanker from beneath the extendable loader assembly.

18. A chemical loading device for loading a molten chemical into a tanker, the chemical loading system comprising:

a source for supplying a molten chemical to the tanker;

a stationary feed line in fluid communication with the source such that the stationary feed line is operable to supply the molten chemical from the source;

an extendable loader assembly having a feed passage in fluid communication with the stationary feed line, the extendable loader assembly being operable to introduce the molten chemical into the tanker, the extendable loader assembly having a retracted position and an extended position relative to the stationary feed line, the feed passage being operable to have at least a portion thereof inside the tanker when the extendable loader assembly is in the extended position;

a ventilation passage that is operable to be in fluid communication with the interior of the tanker when the extendable loader assembly is in its extended position;

a hood with an opening through which the feed passage extends, the hood adapted for substantially enclosing an opening of the tanker when the extendable loader assembly is in its extended position, wherein the ventilation passage does not traverse the hood; and a hoist assembly that selectively extends and retracts the extendable loader assembly between the retracted and extended positions.

19. The chemical loading device of claim 18, further comprising an absence of flexible tubing.

20. The chemical loading device of claim 18, further comprising an absence of swivel joints.

21. The chemical loading device of claim 18, wherein the feed passage further comprises an absence of flexible tubing and swivel joints.

22. The chemical loading device of claim 18, wherein the stationary feed line further comprises an absence of flexible tubing and swivel joints.

23. The chemical loading device of claim 18, wherein the ventilation passage and the feed passage are disposed in a non-concentric fashion.

24. The chemical loading system of claim 1, wherein the ventilation passage extends parallel to the feed passage in a non-concentric fashion.

25. A method for loading molten sulfur into a tanker, the method comprising the steps of:

providing the chemical loading system of claim 18;

positioning the tanker beneath the extendable loader assembly for receiving a molten sulfur;

extending the feed passage to the extended position so that at least a portion thereof is inside the tanker; and conveying the molten sulfur into the tanker from the stationary feed line through the extendable loader assembly.

* * * * *